US008997305B1

(12) United States Patent
Lentine

(10) Patent No.: US 8,997,305 B1
(45) Date of Patent: Apr. 7, 2015

(54) ROTATING MOP HANDLE AND BUCKET ASSEMBLY

(71) Applicant: Telebrands Corp., Fairfield, NJ (US)

(72) Inventor: Lou Lentine, Chattanooga, TN (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 14/512,362

(22) Filed: Oct. 10, 2014

Related U.S. Application Data

(60) Provisional application No. 61/985,364, filed on Apr. 28, 2014, provisional application No. 61/993,354, filed on May 15, 2014.

(51) Int. Cl.
*A47L 13/20* (2006.01)
*A47L 13/58* (2006.01)

(52) U.S. Cl.
CPC *A47L 13/20* (2013.01); *A47L 13/58* (2013.01)

(58) Field of Classification Search
CPC ..... A47L 13/20; A47L 13/58
See application file for complete search history.

(56) References Cited

U.S. PATENT DOCUMENTS

| | | | | |
|---|---|---|---|---|
| 1,943,449 | A * | 1/1934 | Marshall | 15/142 |
| 4,464,809 | A | 8/1984 | Trisolini | |
| 6,006,392 | A | 12/1999 | Seculov et al. | |
| 6,625,838 | B2 | 9/2003 | Laux et al. | |
| 6,675,427 | B1 | 1/2004 | Chiapelli et al. | |
| 6,732,396 | B2 | 5/2004 | Laux et al. | |
| 7,171,720 | B2 | 2/2007 | Rust et al. | |
| 7,174,601 | B1 | 2/2007 | Palmer | |
| 7,540,057 | B2 | 6/2009 | Lin et al. | |
| 8,108,961 | B2 | 2/2012 | Lin et al. | |
| 8,112,840 | B2 | 2/2012 | Chen et al. | |
| 8,214,963 | B2 | 7/2012 | Yu | |
| 8,220,101 | B2 | 7/2012 | Chen | |
| 8,225,454 | B2 | 7/2012 | Yang et al. | |
| 8,291,538 | B2 | 10/2012 | Yang et al. | |
| 8,291,544 | B2 | 10/2012 | Chen et al. | |
| 8,312,587 | B2 | 11/2012 | Chen | |
| 8,316,502 | B2 | 11/2012 | Shao | |
| 8,336,159 | B2 | 12/2012 | Chen et al. | |
| 8,336,160 | B2 | 12/2012 | Chen | |
| 8,347,451 | B2 | 1/2013 | Chen | |
| 8,365,341 | B2 | 2/2013 | Lin | |
| 8,407,845 | B2 | 4/2013 | Yu | |
| 8,407,849 | B2 | 4/2013 | Chen | |
| 8,522,387 | B2 | 9/2013 | Chen | |
| 8,544,133 | B2 | 10/2013 | Fischer et al. | |
| 8,739,347 | B2 | 6/2014 | Lin | |
| 8,756,750 | B2 * | 6/2014 | Shih | 15/263 |

(Continued)

FOREIGN PATENT DOCUMENTS

| | | |
|---|---|---|
| EP | 2255712 | 12/2012 |
| EP | 2255714 | 10/2013 |

(Continued)

*Primary Examiner* — Randall Chin
(74) *Attorney, Agent, or Firm* — Cooper & Dunham LLP

(57) ABSTRACT

A mopping assembly includes a mop bucket having a basket and an interior track formed on an inner surface thereof and a mop having a mop head configured to engage the basket. The basket engages the track on an interior surface of the bucket, so that the basket transitions within an interior portion of the bucket in a vertical direction along the longitudinal axis of the bucket, and the track includes a stop having a notch portion, and wherein the basket is configured to access the notch portion via one or more access paths.

10 Claims, 13 Drawing Sheets

(56) References Cited

U.S. PATENT DOCUMENTS

| | | | |
|---|---|---|---|
| 8,793,834 | B2 | 8/2014 | Lee |
| 8,819,890 | B2 | 9/2014 | Lin |
| 8,826,486 | B2 | 9/2014 | Lee |
| 8,826,487 | B2 | 9/2014 | Lee |
| 2006/0032080 | A1 | 2/2006 | Rust et al. |
| 2006/0048330 | A1 | 3/2006 | Rust et al. |
| 2007/0113418 | A1 | 5/2007 | Palmer |
| 2011/0000044 | A1 | 1/2011 | Chen |
| 2011/0239389 | A1 | 10/2011 | Ting |
| 2011/0271472 | A1 | 11/2011 | Yang et al. |
| 2012/0090122 | A1 | 4/2012 | Lin |
| 2012/0233794 | A1 | 9/2012 | Yu |

FOREIGN PATENT DOCUMENTS

| | | |
|---|---|---|
| WO | 2006114252 | 11/2006 |
| WO | 2006114253 | 11/2006 |

* cited by examiner

ROTATING MOP HANDLE AND BUCKET ASSEMBLY

CROSS REFERENCE TO RELATED APPLICATIONS

This application claims the priority of U.S. Provisional Application No. 61/985,364, filed Apr. 28, 2014, and U.S. Provisional Application No. 61/993,354, filed May 15, 2014, the entire contents of each of which are incorporated herein by reference in their entireties.

TECHNICAL FIELD

This disclosure relates generally to apparatuses and assemblies for cleaning a surface, and more particularly to mop and mop bucket apparatuses and assemblies for cleaning a surface.

BACKGROUND

In general, a variety of apparatuses and assemblies can be used to clean a surface, including, but not limited to, wipes, towels, and/or mops. With respect to mops, cleaning typically involves wetting and re-wetting a mop head in a bucket and wringing the mop head over the bucket before and/or after using the mop head to clean a surface of a floor.

There have been many attempts to create mop assemblies for cleaning. However, these mop assemblies may be problematic, because they may be inefficient by requiring a mop user to move the mop head between buckets and/or different portions of a bucket. Additionally, certain mop assemblies may be problematic because they require a mop assembly user to constantly bend over every time he/she has to wring out the mop, either physically by hand or with a lever to squeeze out the water, causing discomfort to the mop assembly user.

Therefore, there is a need for a user friend mop assembly that allows a mop assembly user to wet, wring out, and re-wet the mop head in an efficient and comfortable manner.

SUMMARY

It is an object of the present invention to provide a system and method for wetting, wringing out, and rewetting of the mop head without removing the mop head from the mop bucket.

In general, in one aspect, the invention includes a mopping assembly. The mopping assembly includes a mop bucket having a basket and an interior track formed on an inner surface thereof and a mop having a mop head configured to engage the basket. The basket engages the track on an interior surface of the bucket, so that the basket transitions within an interior portion of the bucket in a vertical direction along the longitudinal axis of the bucket, and the track includes a stop having a notch portion, and wherein the basket is configured to access the notch portion via one or more access paths.

Implementations of the invention may include one or more of the following features. The mop assembly may include a supporting member disposed in the mop bucket, and the supporting member may releasably engage and support the basket, and the supporting member may include projections that engage the interior track of the mop bucket. The stop may be positioned on the track between a top end of the bucket and a bottom end of the bucket. The projection may be configured to access the notch portion via two access paths. The two access paths may be separated by a rail that defines an edge of each access path. The supporting member may include a central protrusion and the basket is configured to engage the central protrusion via a corresponding recess and rotate about the central protrusion relative to the bucket. The mopping assembly may include an arm extending from the central protrusion of the supporting member, and the projection extends from the arm. The mopping assembly may include a plurality of arms, and each arm may include a projection, and a plurality of tracks, and each track corresponds to one of the plurality of arms and each track may include a stop having a notch portion. The mopping assembly may include mop having a mop base, wherein a recess in a bottom portion of the mop base is configured to engage a central portion of the basket so that the mop base is not rotationally movable with respect to the basket. The mopping assembly may include a plurality of ribs formed in the basket and configured to exert a radially compressive force on the mop head.

DETAILED DESCRIPTION

This disclosure provides apparatuses and assemblies for cleaning a surface. In describing examples and exemplary embodiments shown in the Figures, specific terminology may be employed for the sake of clarity. However, this disclosure should not be limited to the specific terminology so selected, and it should be understood that each specific element includes all technical equivalents that may operate in a similar manner.

Figure 1:
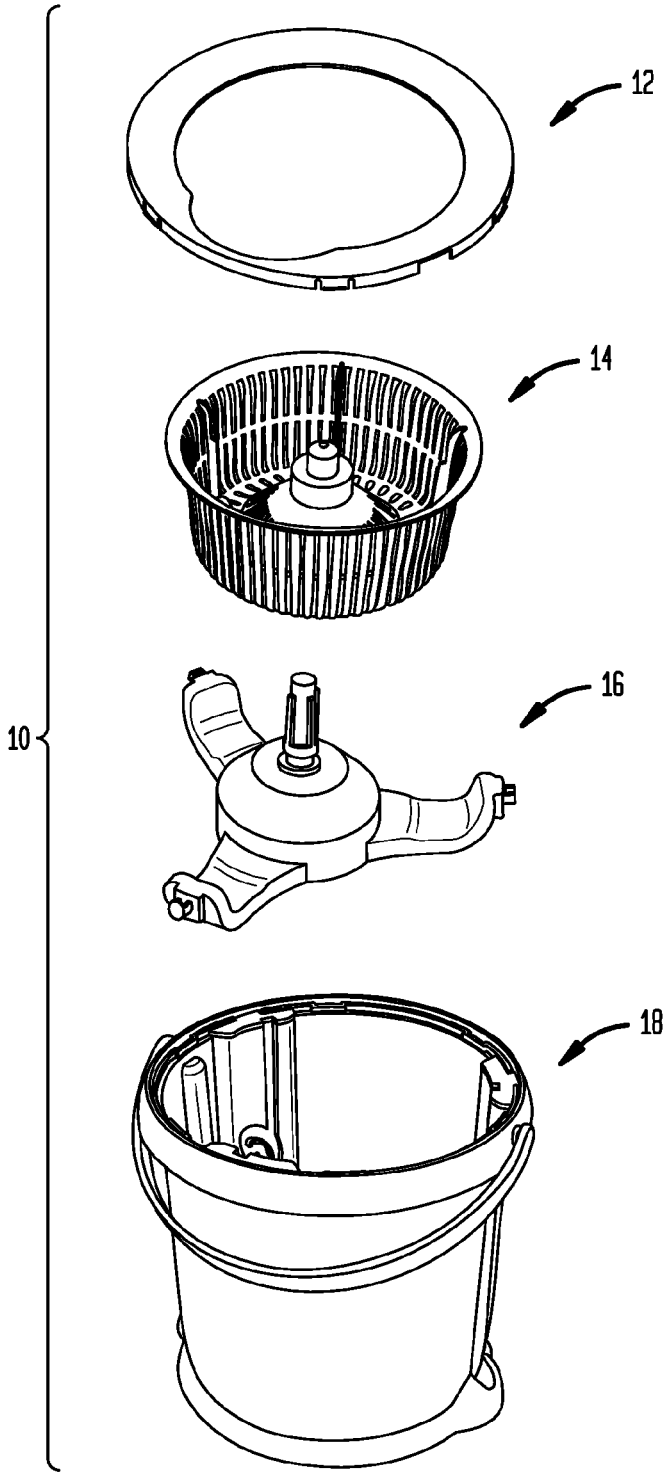
FIG. 1 shows an exploded view of a mop bucket assembly, according to an exemplary embodiment.
Figure 2:
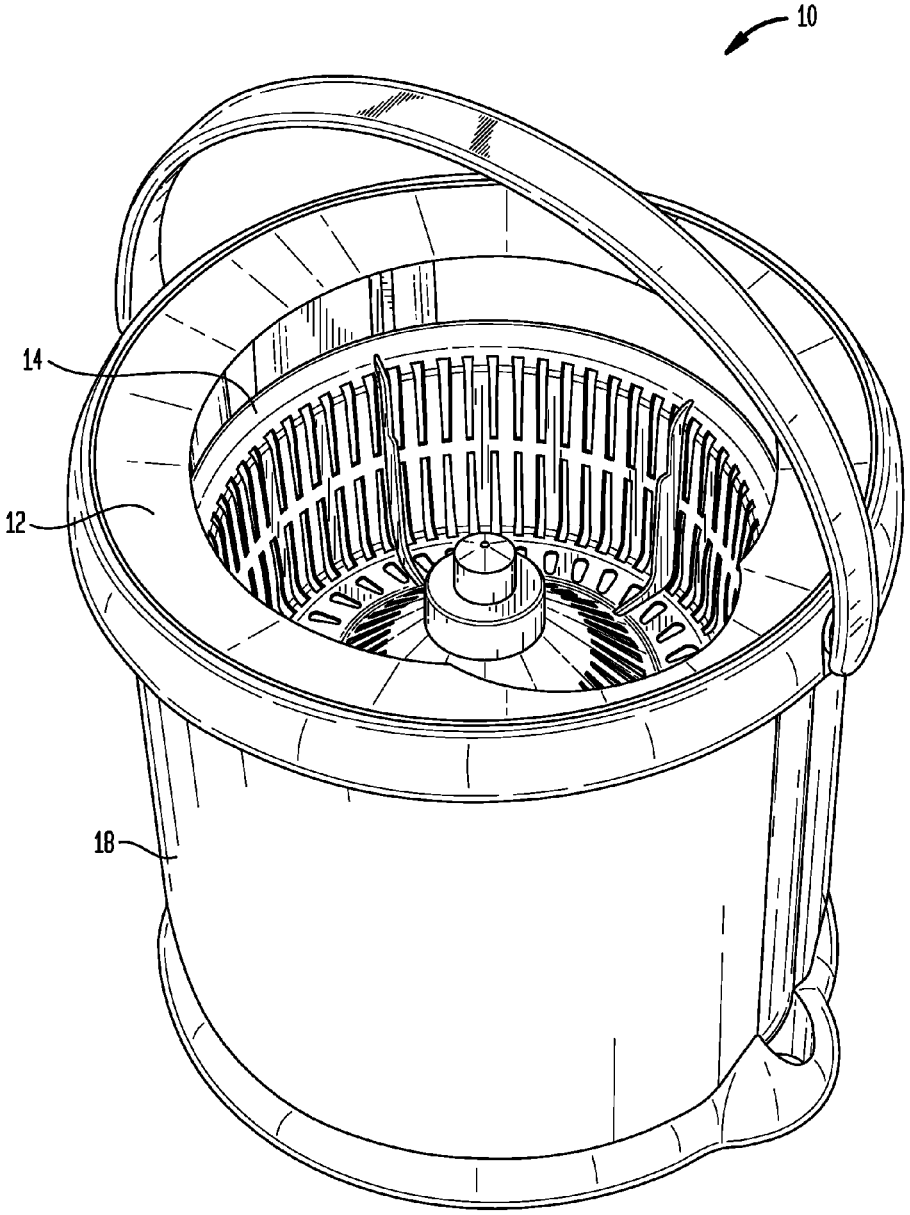
FIG. 2 shows the mop bucket assembly of FIG. 1.

Referring now to the Figures, wherein like reference numerals designate identical or corresponding parts throughout the several views, FIGS. 1 and 2 show a mop bucket assembly 10, according to an exemplary embodiment. The mop bucket assembly 10 may be any apparatus that may be configured to allow for wetting, wringing out, and re-wetting of a mop therein. FIG. 1 shows that the mop bucket assembly 10 may include a rim 12, a basket 14, a supporting member 16, and a bucket 18.

Figure 8:
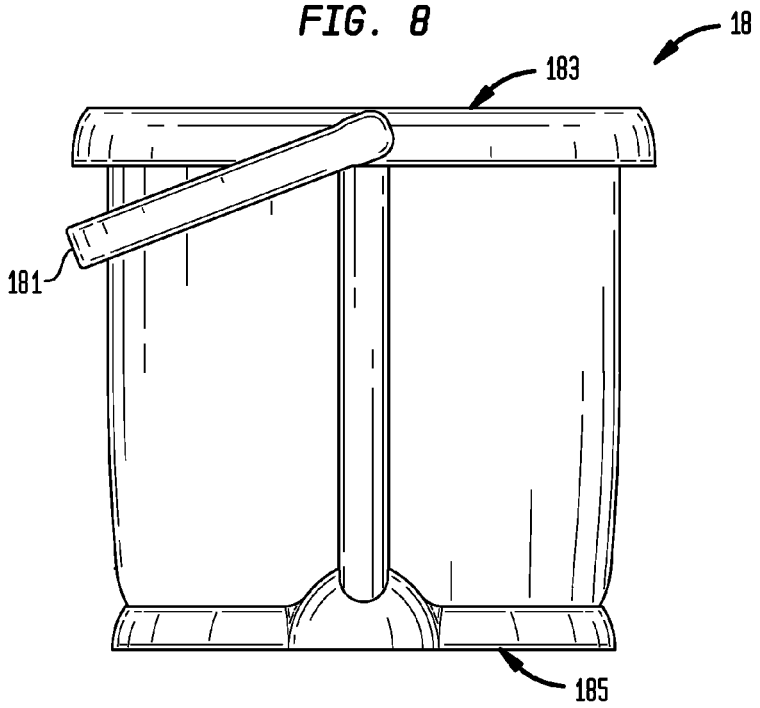
FIG. 8 shows an exterior portion of the mop bucket assembly of FIG. 1.

FIGS. 1 and 8 illustrate that the bucket 18 may include a handle 181. The mop bucket 18 and the handle 181 may be made of any desired material and may each be any size, shape, and/or configuration such that when a liquid is contained within the bucket 18, a user may hold the bucket 18 with the handle 181.

The rim 12 may be sized, shaped, and/or configured to cooperate with an open end 18*a* of the bucket 18. In some embodiments the rim 12 may be integral with the open end 18*a* of the bucket 18. Alternatively, in some embodiments, the rim 12 may be configured to removably engage the open end 18*a* of the bucket 18. The rim 12 may removably engage the open end 18*a* of the bucket 18 via any engagement mechanism known to those skilled in the art. For example, FIG. 3 shows that the rim 12 may include one or more tabs 124 and/or openings 126 that may be configured to engage one or more corresponding features on the open end 18*a* of the bucket 18.

Figure 3:
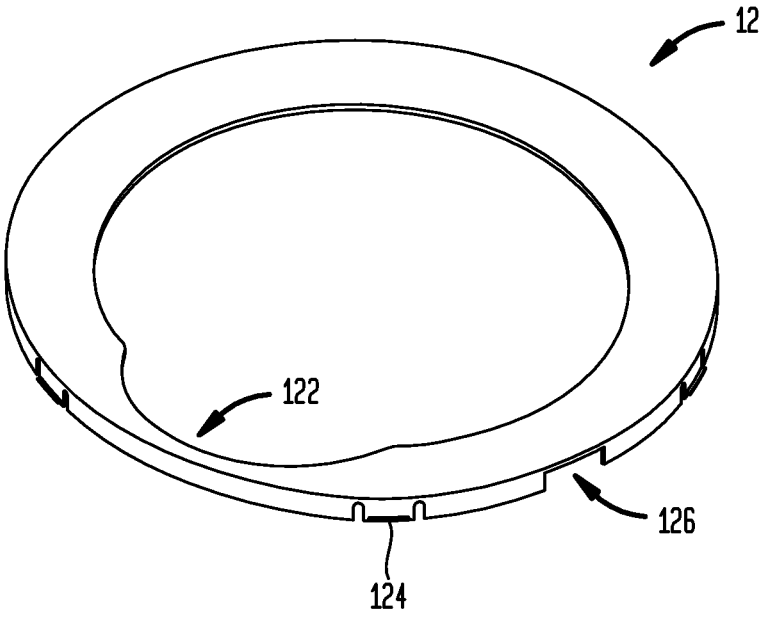
FIG. 3 shows the rim of the mop bucket assembly of FIG. 1.

FIG. 3 shows that the rim 12 may include one or more indentations 122. The one or more indentations 122 may be sized, shaped, and/or configured as a spout, having an angled portion, such that a user may easily pour a liquid out of the bucket 18. In some embodiments, the rim 12 may include a single indentation 122 (see FIG. 3). Alternatively, in some embodiments, the rim 12 may include a plurality of indentations 122 spaced around the rim 12, such that a mop bucket assembly user may be configured to easily pour liquid out of the bucket 18 from a plurality of locations at the open end 18*a* of the bucket 18.

Figure 4:
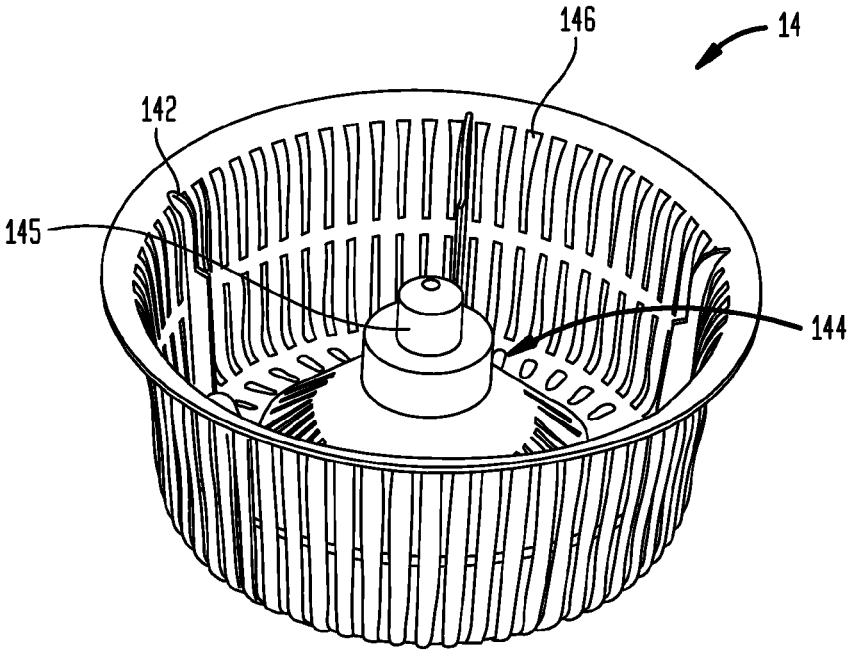
FIGS. 4 and 5 show the basket of the mop bucket assembly of FIG. 1.
Figure 5:
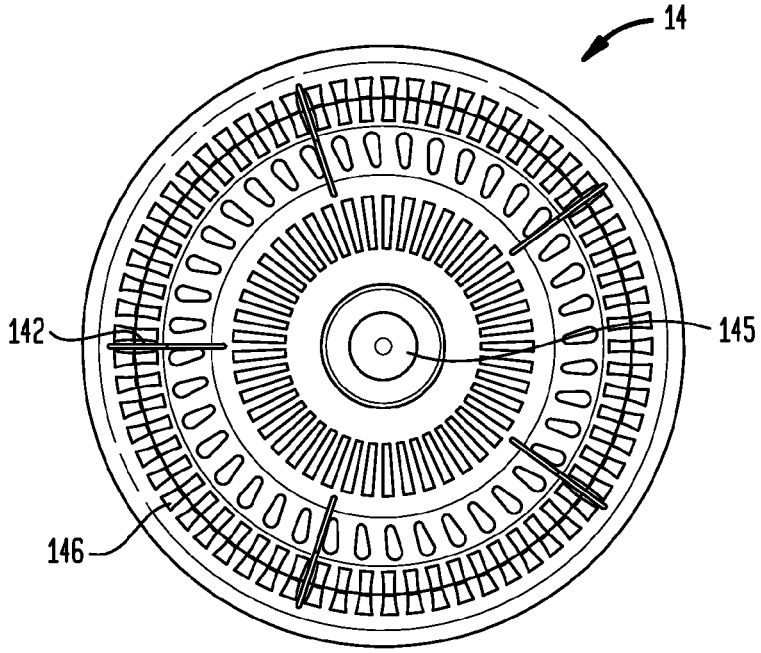

As previously discussed, the mop bucket assembly 10 may include a basket 14. FIG. 2 shows that the basket may be sized, shaped, and/or configured to fit within an interior of the bucket 18. The basket 14 may further be sized, shaped, and/or configured to rotate within the bucket 18. As shown in FIGS. 4 and 5, the basket 14 may include a plurality of openings 146. The plurality of openings 146 may be any size and/or shape so long as they may be configured to enable a liquid to pass therethrough.

In some embodiments, the basket 14 may include one or more mop head retaining means 142. The mop head retaining means 142 may be any mechanism that may be configured to retain a mop head in a portion of the basket 14 and substantially prevent the mop head from moving relative to the basket 14. For example, in some embodiments, as illustrated in FIGS. 4 and 5, the mop head retaining means 142 may include a plurality of ribs circumferentially spaced around an interior portion of the basket 14. The ribs may be configured to engage at least a portion of the mop head by applying a friction and/or radial clamping force on the mop head. For example, in some embodiments, the ribs 142 may include a deformable material that may be configured to radially clamp onto a portion of the mop head 22 in response to insertion of the mop head 22 in the basket 14. FIGS. 4 and 5 illustrate that the ribs extend vertically within the interior portion of the basket 14. In other embodiments, the ribs may extend in any direction within the basket 14 so long as the ribs may be configured to exert a clamping force on the mop head. FIGS. 4 and 5 also illustrate an embodiment including five (5) ribs. Alternative embodiments may include any desired number of ribs so long as the ribs may be configured to substantially prevent the mop head from rotating relative to the basket 14.

Figure 11:
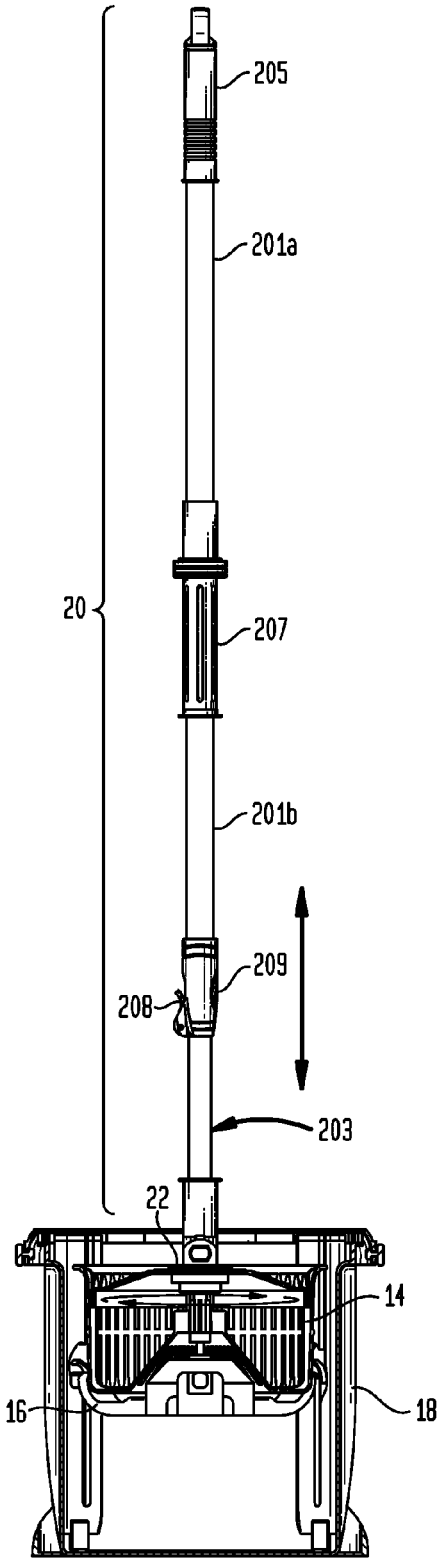
FIGS. 11 and 12 show a mop assembly interacting with the mop bucket assembly of FIG. 1.
Figure 12:
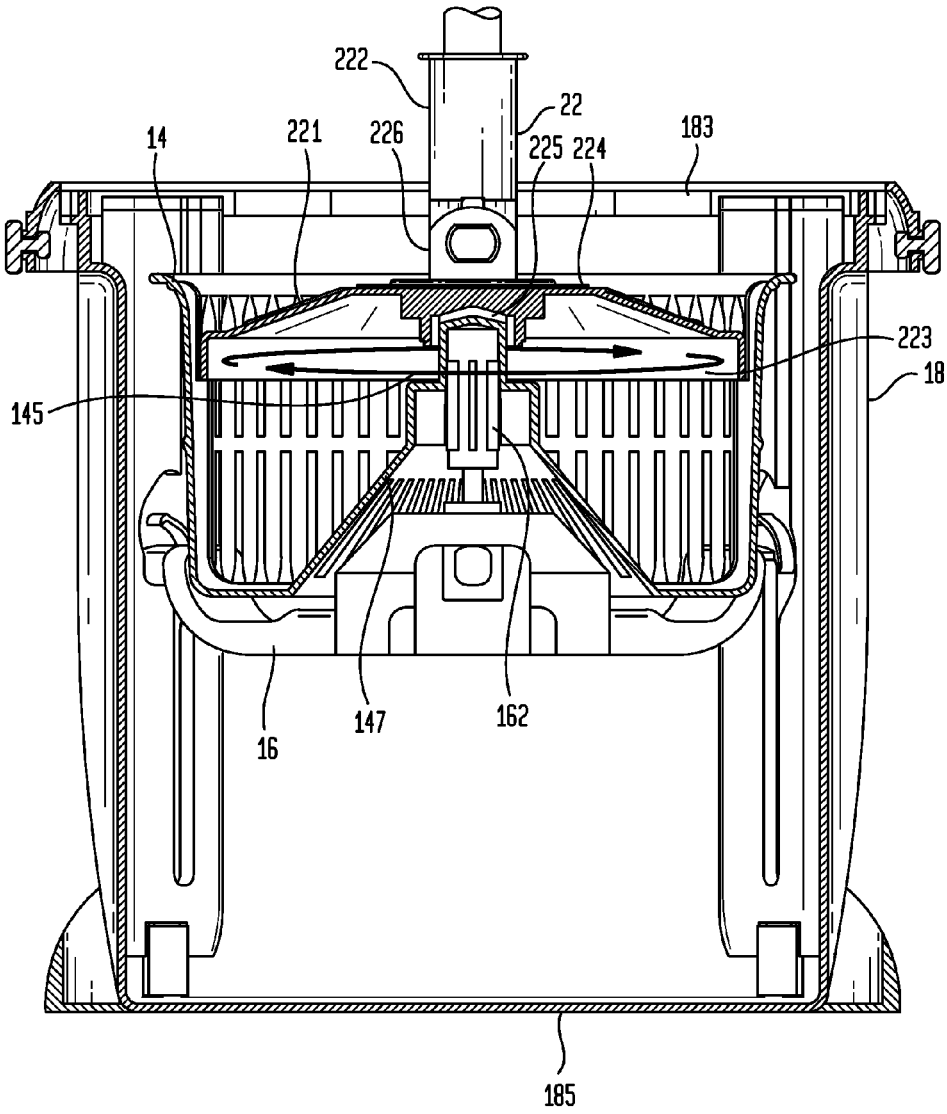

In addition to the mop head retaining means 142, the basket 14 may include a central portion 144 that may be any desired size, shape, and/or configuration so long as it may be configured to removably engage the mop head 22 (see FIGS. 11 and 12). For example, in some embodiments, such as those illustrated in FIGS. 4 and 5, the central portion 144 of the basket 14 may include a single cylindrical 145 projection. FIGS. 11 and 12 show that the cylindrical projection 145 of the central portion 144 of the basket 14 may be configured to engage a corresponding opening 225 in a bottom portion 223 of a base 221 of the mop head 22. In alternative embodiments, the central portion 144 of the basket 14 may contain a plurality of cylindrical projections (not shown) that may be configured to engage a corresponding number of openings in the bottom portion 223 of the mop head 22.

Figure 6:
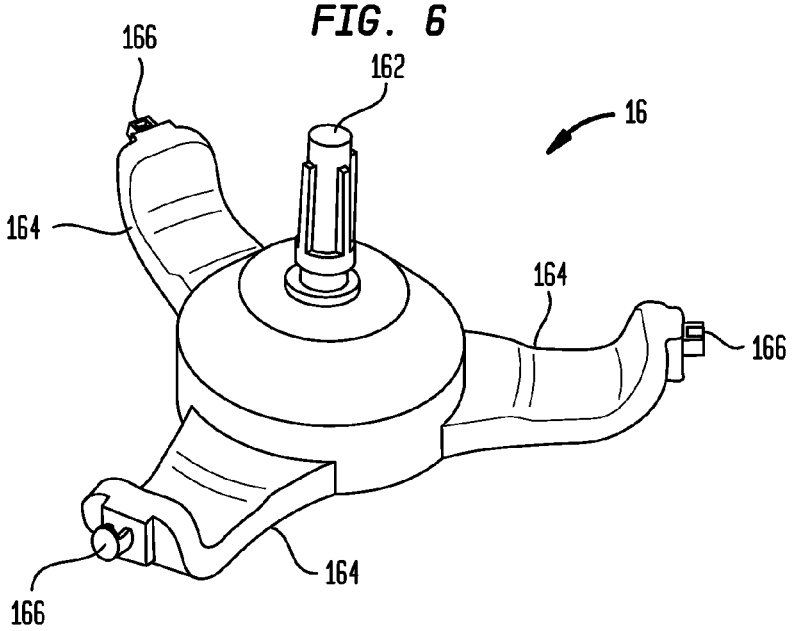
FIGS. 6 and 7 show the supporting member of the mop bucket assembly of FIG. 1.
Figure 7:
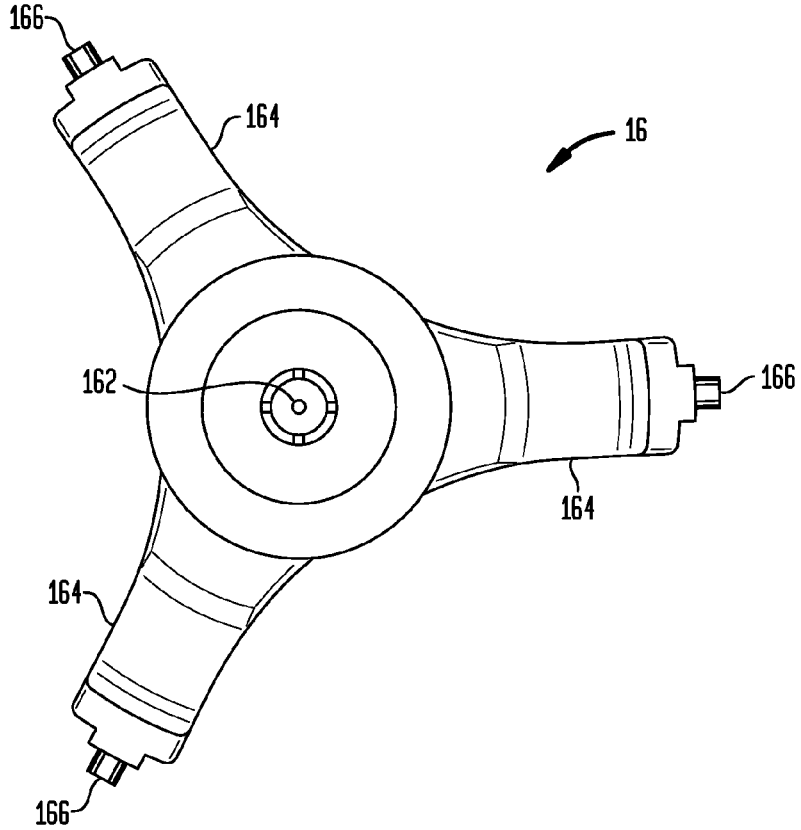

In some embodiments, the central portion 144 of the basket 14 may be configured to rotatably engage a supporting member 16 that may be located in an interior portion 184 of the bucket 18. As illustrated in FIGS. 6 and 7, in some embodiments, the supporting member 16 may include a central protrusion 162. The central portion 144 of the basket 14 may be sized, shaped and/or configured to rotatably engage the central protrusion 162 of the supporting member 16 in a manner such that the basket 14 may be configured to rotate about the central protrusion 162 of the supporting member 16 with respect to the bucket 18. For example, as illustrated in FIG. 12, in some embodiments the central portion 144 of the basket 14 may include a recess 147 on the underside thereof. As illustrated in FIG. 12, the recess 147 on the underside of the central portion 144 of the basket 14 may be configured to engage the central protrusion 162 of the supporting member 16. In alternative embodiments the central protrusion 162 of the supporting member 16 may include an upward facing recess (not shown) and the central portion 144 of the basket 14 may include downward facing projection configured to engage the recess such that the basket 14 may be configured to rotate about the central protrusion 162 of the supporting member 16 with respect to the bucket 18.

In some embodiments the supporting member 16 may include one or more arms 164 extending from a base of the central protrusion 162. The one or more arms 164 may be any size, shape, and/or configuration so long as they may be configured to engage an interior portion 184 of the bucket 18 in a rotationally locked relationship such that the supporting member 16 may be substantially prevented from rotating relative to the bucket. FIGS. 6 and 7 illustrate an embodiment where the supporting member 16 includes three arms 164. Alternative embodiments may include any desired number of arms so long as the supporting member 16 may be configured to fit within and engage the interior portion 184 of the bucket 18.

The one or more arms 164 and the interior portion 184 of the bucket 18 may include corresponding engagement components. For example, the one or more arms 164 may be configured to engage the interior portion 184 of the bucket 18 via a snap fit, friction fit, threading, and/or any other type of engagement known to those skilled in the art. In some embodiments, the engagement components may be configured such that when the one or more arms 164 engage the interior portion 184 of the bucket 18, the supporting member 16 may be configured to maintain a single position with respect to the vertical axis in the interior portion 184 of the bucket 18, for example, when liquid drains from and/or is not in the mop bucket 18.

Figure 9:
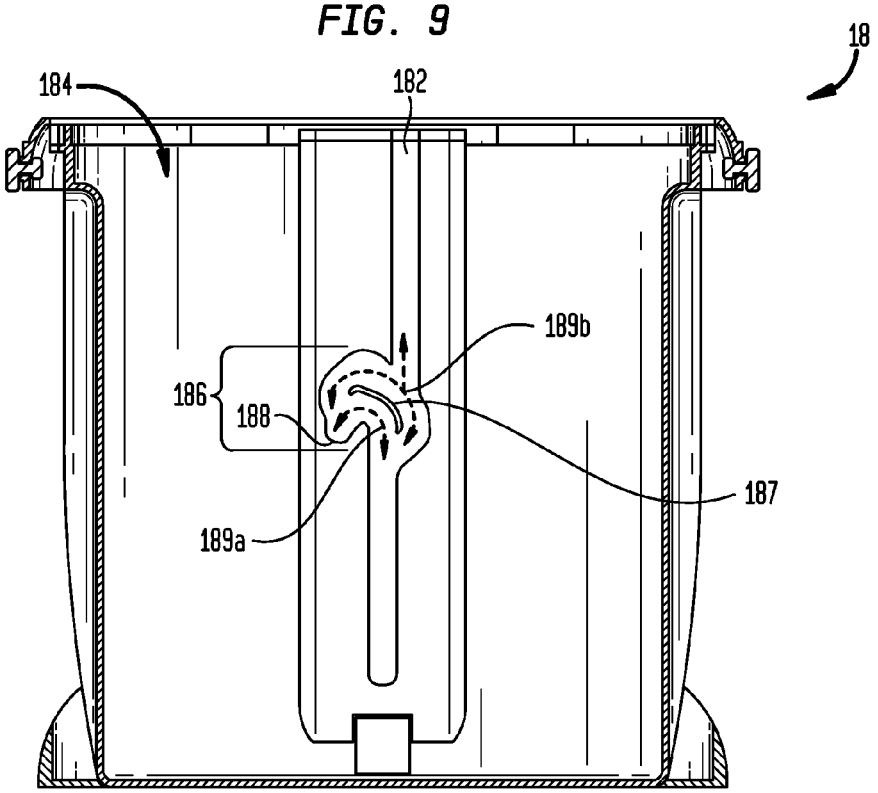
FIGS. 9 and 10 show interior portions of the mop bucket assembly of FIG. 1.
Figure 10:
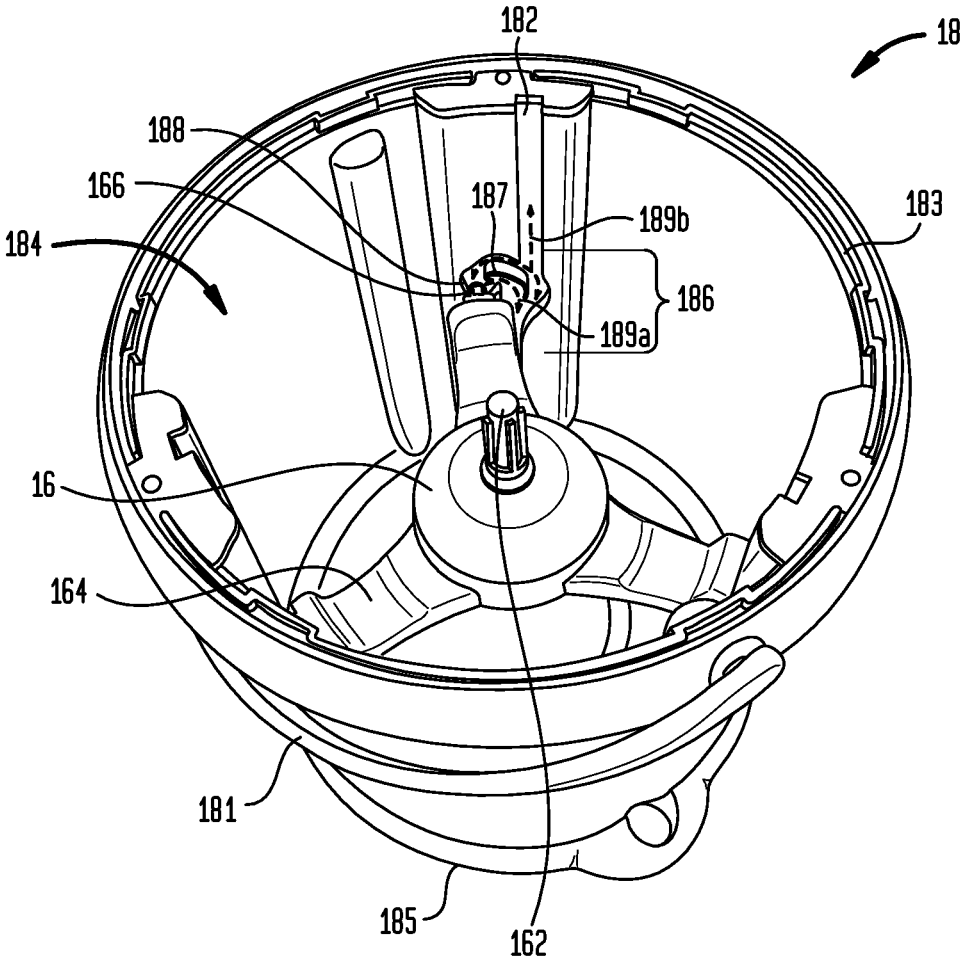

Alternatively, in some embodiments, the engagement components may be configured such that when the one or more arms 164 engage the interior portion 184 of the bucket 18, the supporting member 16 may be configured to move in a vertical direction along the longitudinal axis of the interior portion 184 of the bucket 18. For example, in some embodiments and as shown in FIGS. 6 and 7, the one or more arms 164 may each include a projection 166 extending from an end thereof. FIG. 10 illustrates that each projection 164 may be configured to engage a respective track 182 located on a surface of the interior portion 184 of the bucket 18. As illustrated in FIG. 9, each track 182 may extend vertically along the length of the interior portion 184 of the bucket 18. The projections 164 may be configured to engage each respective track 182 in a manner such that the supporting member 16 may be configured to transition up and down in a vertical direction within the bucket 18 and along the track 182.

FIG. 9 illustrates that each track 182 may include a stop 186. The stop 186 may include a notch portion 188. In some embodiments, the projection 166 on the arm 164 of the supporting member 16 may be configured to engage the notch portion 188 of the track 182 when the supporting member 16 is moved in a vertical direction. For example, as illustrated in FIG. 10, in some embodiments, the supporting member 16 may be configured to maintain a position between the top and bottom of the bucket 18 when each projection 166 engages with a respective notch portion 188 on the track.

Each stop 186 may be positioned on each respective track 182 such that when the projections 166 engage the respective notch portions 188, the supporting member 16 may be configured to maintain the basket 14 at a position above liquid within the bucket 18. Each stop 186 may also be positioned on each respective track 182 based on the size of the basket 14 and/or the size of the bucket 18. For example, in some embodiments the stop 186 may be positioned along the track 182 such that when the basket 14 is rotatably engaged with the central protrusion 162 of the support member 16 and when the projections 166 are located within the notch portions 188, the basket 14 may substantially be positioned within the interior 184 of the bucket 18 such that the basket 14 does not extend beyond the open end 183 of the mop bucket 18 (see e.g., FIG. 11).

FIG. 9 illustrates that the notch portion 188 may be accessed via one or more access paths 189*a*, 189*b* that may be positioned along the track 182 and within the stop 186. The one or more access paths may be sized, shaped, and/or configured such that each projection 166 may be configured to have access in and out of each respective notch portion 188. For example, as illustrated in FIG. 9, in some embodiments, the track 182 may include a first access path 189*a* and a second access path 189*b*.

The first and second access paths 189*a*, 189*b* may be separated by at least one rail 187. The at least one rail 187 may be configured to define an edge of each of the first and second access paths 189*a*, 189*b*. The rail 187 may be positioned along the track 182 and within the stop 186 such that when the supporting member 16 transitions in a vertical direction from a position below the stop 186 towards the top of the mop bucket 18, a projection 166 engaging the track 182 may be configured to abut the rail 187 and access the notch portion 188 via the first access path 189*a*.

The rail 187 may further be positioned such that the projection 166 may be configured to exit the notch portion 188 via the second access path 189*b*. The second access path 189*b* may be in communication with the track 182 such that when the projections 166 exit their respective notch portions 188 along their respective second access paths 189*b*, the supporting member 16 may be configured to transition in a vertical direction from the stop 186 to a position below the stop 186 towards the bottom of the bucket 18.

In addition to being configured to transition along the track 182 in a vertical direction towards the bottom of the mop bucket 18, the supporting member 16 may be configured to transition along the track 182 in a vertical direction towards the top of the mop bucket 18. Transition of the supporting member 16 in this manner may be desired, for example, when a user removes the basket 14 and supporting member 16 from the mop bucket 18 in order to clean the mop bucket 18 or to empty liquid or water from the mop bucket 18.

In the embodiments discussed herein, the projections 166 may not be limited to accessing the respective notch portions 188 via the first access path 189*a* and exiting the respective notch portions 188 via the second access path 189*b*. Rather, the projections 166 may be configured to access and exit the respective notch portions 188 via any of the first and second access paths 189*a*, 189*b*.

Figure 13:
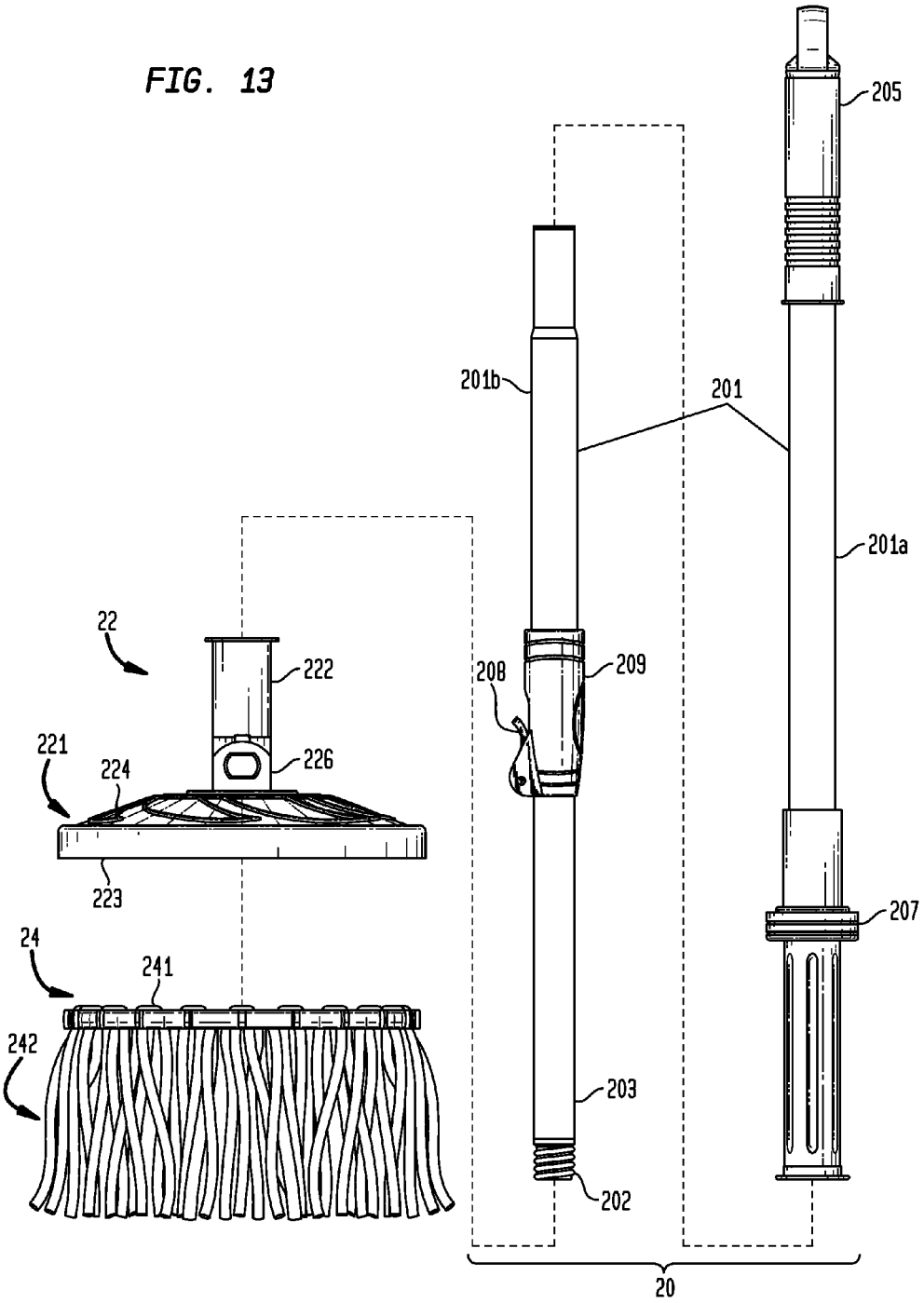
FIG. 13 shows an exploded view of a mop assembly, accordingly to an exemplary embodiment.

FIG. 11 illustrates a mop assembly 20 that may be configured to interact with the mop bucket assembly 10. As shown in FIG. 13, the mop assembly 20 may include a mop head 22. In some embodiments, the mop head 22 may be sized, shaped, and/or configured to be positioned within the bucket 18 and the basket 14. For example, the mop head 22 may be sized and shaped such that it may be configured to be inserted through the open end 18*a* of the bucket 18, and further such that it may be configured to fit within the interior of the basket 14.

The mop head 22 may include a connector portion 222 and a base portion 221. As previously discussed, the base portion 221 may be configured to engage the central portion 144 of the basket 14, as shown in FIGS. 11 and 12. In addition, FIG. 13 shows that the base portion 221 may be configured to engage a mop portion 24. The mop portion 24 may include a mop ring 241 that may be configured to engage the bottom portion 223 of the base portion 221 via any engaging means known to those skilled in the art, including, but not limited to a snap fit and/or a friction fit. In some embodiment, as shown in FIG. 13, the mop ring 241 may be configured to engage a material 242 that may be configured to absorb liquid and clean a surface. The material 242 may include, but is not limited to cloth or a sponge. In some embodiments, such as the embodiment shown in FIG. 13, the material 242 may be strips of cloth that may be configured to be woven through at least a portion of the mop ring 241.

Figure 18:
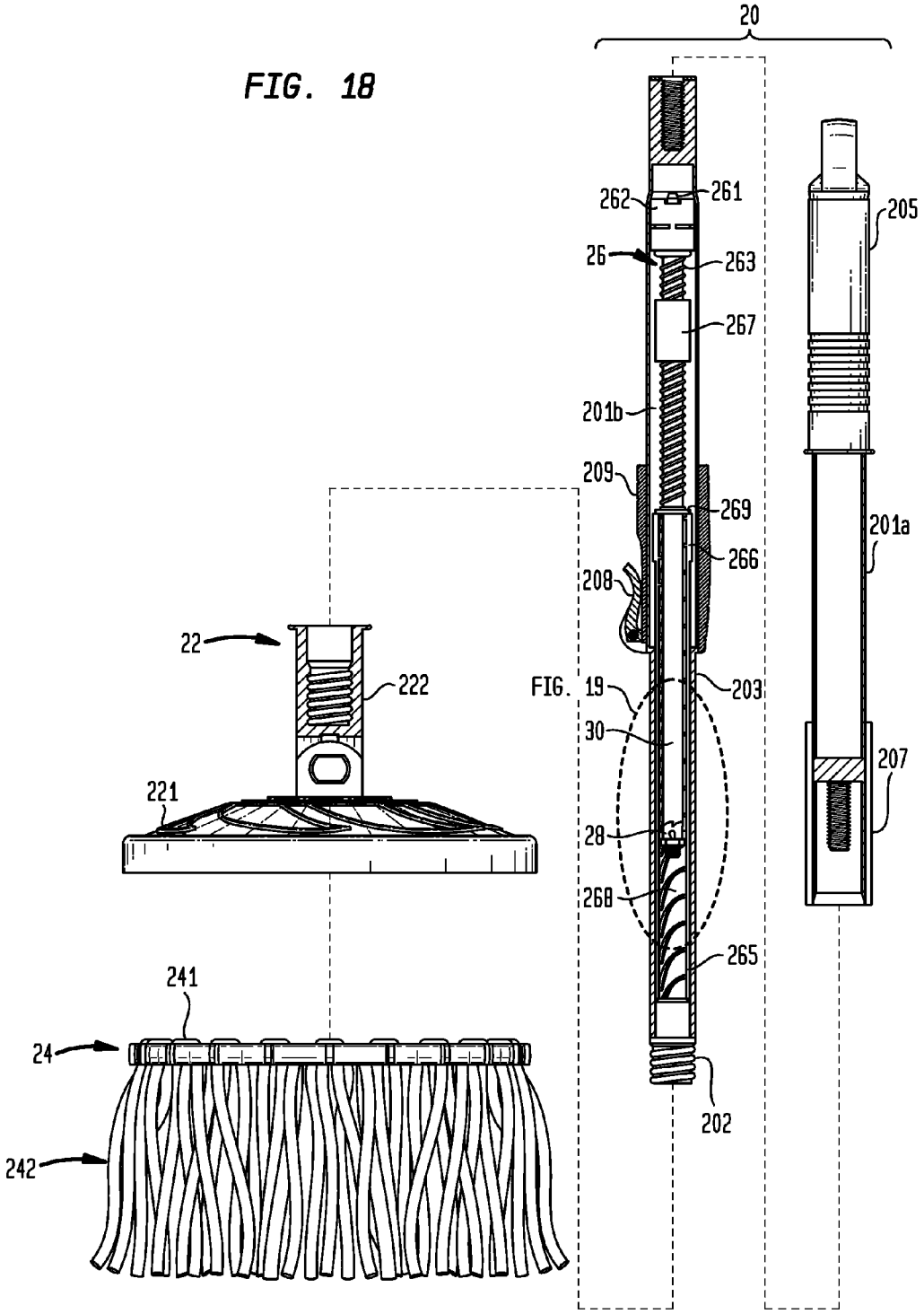
FIG. 18 shows a cross-section of the mop assembly of FIG. 13.

The base portion 221 may be configured to angularly move about the connector portion 222. As illustrated in FIGS. 12 and 13, the connector portion 222 may extend from a top 224 of the base portion 221 and may be configured to removably engage an end 202 of the mop handle 20 via any engagement means known to those skilled in the art, including, but not limited to, a snap fit and a friction fit. In some embodiments, as illustrated in FIG. 18, the connector portion 222 may be configured to engage the end 202 of the mop handle 20 via threading.

FIGS. 11 and 12 illustrate that the mop handle 20 may be configured to extend from the connector portion 222 of the mop head 22. In some embodiments, the mop handle 20 may include at least two telescoping pieces 201, 203. For example, as illustrated in FIG. 13, the mop handle 20 may include a first telescoping piece 201 and a second telescoping piece 203. In some embodiments, each telescoping piece 201, 203 may be a single hollow piece. Alternatively, in some embodiments, as illustrated in FIG. 13, at least one of the telescoping pieces 201 may include a plurality of hollow interconnected pieces 201*a*, 201*b*. For example, in one embodiment, the first telescoping piece 201 may include two interconnecting pieces 201*a*, 201*b*. The interconnecting pieces 201*a*, 201*b* may be configured to engage via any connection means known to those skilled in the art, including, but not limited to, a snap fit or a friction fit. Alternatively, or in addition, in some embodiments, and as shown in FIG. 18, the interconnecting pieces 201*a*, 201*b* may be configured to engage via threading.

FIGS. 11 and 13 further illustrate that the first telescoping piece 201 may include one or more gripping portions 205, 207. The one or more gripping portions 205, 207 may each include surfaces that allow for a mop assembly user to grip the mop assembly 20 during use, and may be of any design known to one of ordinary skill in the art.

FIGS. 11 and 13 further illustrate that in some embodiments the mop handle 20 may include a locking mechanism 209. The locking mechanism 209 may be configured to maintain the first telescoping piece 201 in a selected position relative to the second telescoping piece 203. In some embodiments, the locking mechanism 209 may be configured such that when the locking mechanism 209 is engaged, the first and second telescoping pieces 201, 203 remain in a substantially fixed position relative to one another, and such that when the locking mechanism 209 is disengaged, the first and second telescoping pieces 201, 203 may move relative to one another along a longitudinal axis of the mop handle 20. Additionally, the locking mechanism 209 may be configured such that when the locking mechanism 209 is disengaged, the first and second telescoping pieces 201, 203 may rotate with respect to one another.

The locking mechanism 209 may be configured to fix the first and second telescoping pieces 201, 203 relative to one another via application of a circumferential compression force. The compression force may be applied to the first and/or second telescoping pieces 201, 203 in manner such that when the compression force is above a predetermined threshold, the first and second telescoping pieces 201, 203 compress relative to one another such that the first telescoping piece 201 is substantially prevented from moving relative to the second telescoping piece 203. Accordingly, the locking mechanism 209 may be designed to include any components known to those skilled in the art that, when engaged, may be configured to exert the compression force described herein on the first and second telescoping pieces 201, 203 and when disengaged, may be configured to release the compression force. In some embodiments, the locking mechanism may include a system of two or more hollow sleeves configured move relative to one another (rotatably or longitudinally) and transition the first and second telescoping pieces 201, 203 from a fixed position to a non-fixed, telescoping position. Alternatively, in some embodiments, and as shown in FIGS. 11 and 13, the locking mechanism 209 may include a lever 208 that may be configured to transition from a locked and engaged position to an unlocked and disengaged position.

FIG. 18 illustrates that in some embodiments, the mop handle 20 may additionally include an internal rotating mechanism therein which may be configured to cause the second telescoping piece 203 to rotate when the first telescoping piece 201 is pushed and/or moved downward towards the mop head 22. The rotating mechanism 26 may be configured such that when the locking mechanism 209 is disengaged and a downward force is applied to the first telescoping piece 201, the second telescoping piece 203 may be configured to rotate. The rotating mechanism 26 may further be configured to translate rotational forces to the mop head 22 and to the basket 14. For example, when a user engages the bottom 225 of the mop base 221 with the central portion 144 of the basket 14 in the mop bucket 18 and applies a downward force on the first telescoping piece 201, simultaneous rotation of the second telescoping piece 203, the mop head 22, and the basket 14 may result in a manner described herein.

Translation of rotational forces via the rotating mechanism 26 may be accomplished by engagement of the rotating mechanism 26 with each of the first and second telescoping pieces 201, 203. The first telescoping piece 201 may include two pieces—an upper piece 201*a* and a lower piece 201*b*—that interconnect and may disconnect for ease of storage. For example, as shown in FIG. 18, in some embodiments, the rotating mechanism 26 may be configured to extend between and within the first and second telescoping pieces 201, 203 such that at least a portion 262 of the rotating mechanism 26 may be configured to engage the lower first telescoping piece 201*b*, and at least a portion 266 of the rotating mechanism 26 may be configured to engage the second telescoping piece 203 in a manner described herein.

Figure 16:
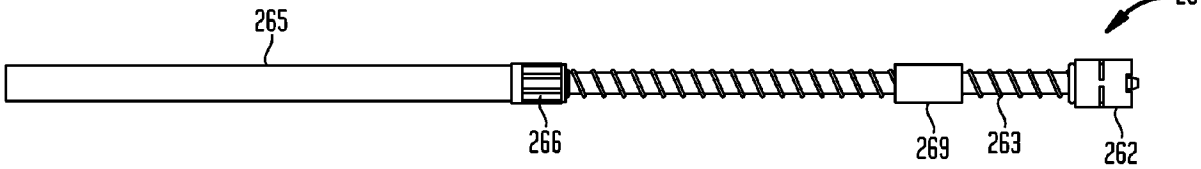
FIG. 16 shows a handle rotating mechanism, according to another exemplary embodiment.
Figure 17:
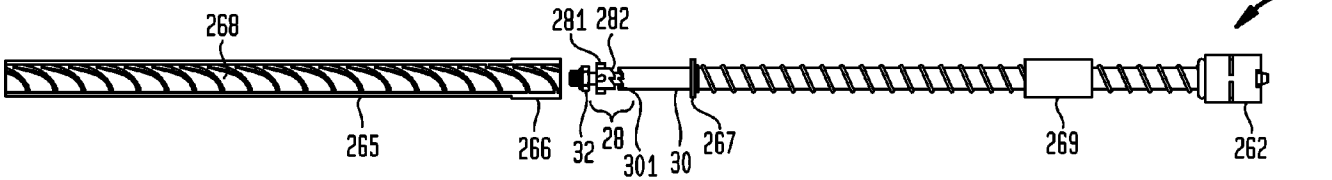
FIG. 17 shows a cross-section of the handle rotating mechanism of FIG. 16.

FIGS. 16 and 17 illustrate that the rotating mechanism 26 may include an elongate rod 261. The elongate rod 261 may be sized, shaped, and/or configured to extend between the first telescoping piece 201 and the second telescoping piece 203. FIGS. 16 and 17 additionally illustrate that the rod 261 may include a plug 262 at an end thereof. The plug 262 may be sized, shaped, and/or configured such that it may be the portion 262 of the rotating mechanism 26 that may be configured to engage the first telescoping piece 201. For example, as shown in FIG. 18, the plug 26 may be configured to engage the interior portion of the first telescoping piece 201*b*. The plug 262 may be configured to engage the interior portion of the lower first telescoping piece 201*b* via any engagement means known to those skilled in the art, including, but not limited to, snap fit, friction fit, or threading.

Figure 14:
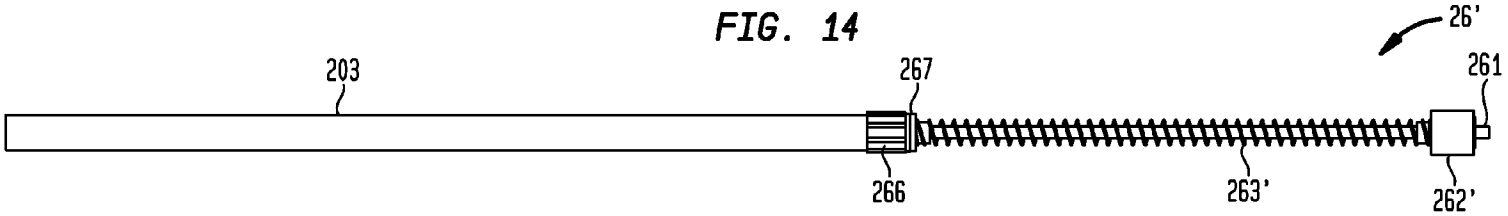
FIG. 14 shows a handle rotating mechanism, according to an exemplary embodiment.

In some embodiments, the plug 262 may be configured to cooperate with the end of the rod 261 such that when the plug 262 engages the interior portion of the lower first telescoping piece 201*b*, the rod 261 may remain in a fixed position relative to the first telescoping piece 201. FIGS. 14 and 16 illustrate that in some embodiments of the rotating mechanism 26, 26', the end of the rod 261 may be configured to extend beyond a top end of plug 262, 262'. Alternatively, in other embodiments of the rotating mechanism 26", such as the embodiment of FIG. 15, the plug 262" may be configured to substantially cover the end of the rod 261.

Figure 15:
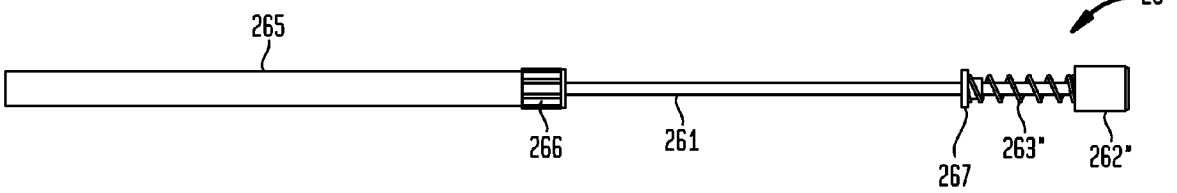
FIG. 15 shows a handle rotating mechanism, according to another exemplary embodiment.

FIGS. 15 and 16 illustrate that in some embodiments, the rotating mechanism 26 may further include a hollow tube 265. In some embodiments, the hollow tube 265 may be the portion of the rotating mechanism 26 that may be configured to engage the second telescoping piece 203 such that when the hollow tube 265 engages the second telescoping piece 203, the hollow tube 265 may remain in a substantially fixed position relative to the second telescoping piece 203.

FIGS. 14 and 18 illustrate exemplary embodiments of the hollow tube 265 engaged with the second telescoping piece 203. For example, FIGS. 14 and 18 illustrate that in some embodiments, the hollow tube 265 may include a cuff 266 at an end thereof that may be configured to engage an end of the second telescoping piece 203. As illustrated in FIGS. 14 and 18, the cuff 266 may be sized, shaped, and/or configured such that when the hollow tube 265 is inserted into the second telescoping piece 203, the cuff 266 may be configured to engage the end of the second telescoping piece 203 via engagement means that include, but are not limited to, snap fit, friction fit, and/or threading.

Figure 19:
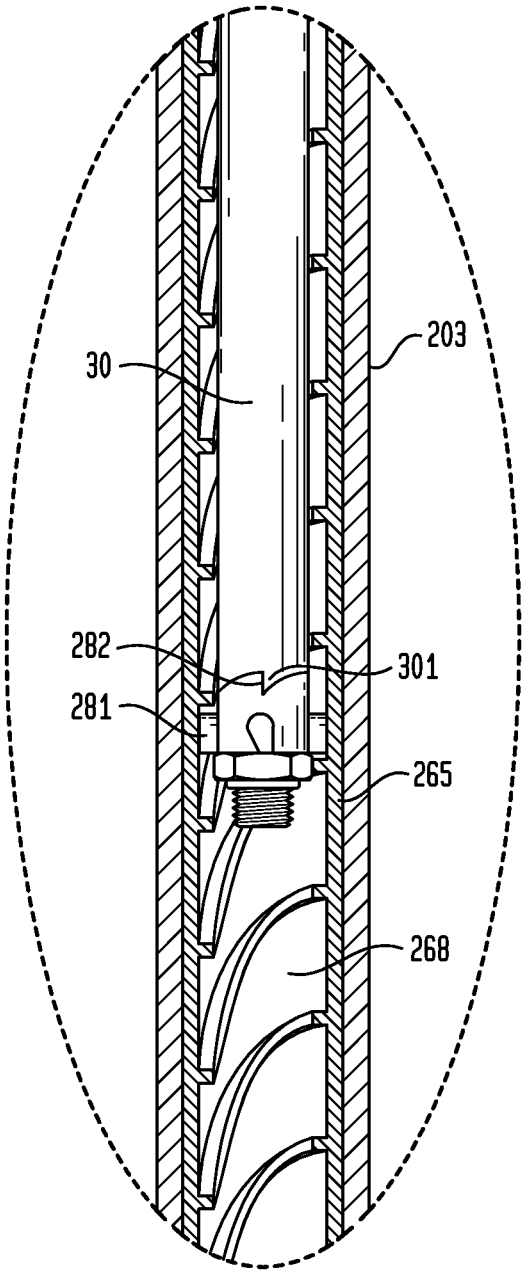
FIG. 19 shows an exploded view of a portion of the cross-section of the mop assembly of FIG. 18.

The hollow tube 265 may be configured such that the rod 261 may engage and translate in a co-linear direction within a hollow tube 265. For example, in some embodiments, the rod 261 may be configured to engage an interior portion 268 of the hollow tube 265 via a rotational end piece 28. FIGS. 17-19 illustrate that in some embodiments, the rotational end piece 28 may be positioned at a second end portion of the rod 261 opposite the plug 262. The rotational end piece 28 may be configured such that it may rotate about the second end of the rod 261.

As illustrated in FIGS. 17-19, the rotational end piece 28 may include a plurality of projections 281. FIGS. 18 and 19 illustrate that the plurality of projections 281 may be configured to engage a spiral track 268 extending along an interior portion for the hollow tube 265. The plurality of projections 281 may be sized, shaped, and/or configured such that when a linear force is applied to the rod 261, the plurality of projections 281 on the rotational end piece 28 may be configured to engage the spiral track 268 and translate in a linear direction along the spiral track 268.

The plurality of projections 281 may further be sized, shaped, and/or configured such that when a linear force is applied to the rod 261 that causes the first telescoping piece 201 to move in a downward direction towards the mop base 22, the rotational end piece 28 may be configured cause rotation of hollow tube 265 in a first direction relative to and about the rod 261. Moreover, the plurality of projections may be sized, shaped, and/or configured such that when a linear force is applied to the rod 261 that causes the first telescoping piece 201 to move in an upward direction away from the mop base 22, the rotational end piece 28 may be configured to rotate about the rod 261 in a second direction, opposite the first direction, without causing rotation of the hollow tube 265.

The rotational end piece 28 may be configured to cause rotation of the hollow tube 265 in the first direction and not in the second direction, i.e., in only one direction, via the aid of a clutch mechanism 30. For example, FIGS. 17-19 illustrate a clutch mechanism 30, according to an exemplary embodiment. As illustrated in FIGS. 17-19, the clutch mechanism may be positioned circumferentially about the rod 261 and may include a plurality of teeth 301 that may be configured to engage a plurality of corresponding teeth 282 extending from the rotational end piece 28.

In some embodiments, the clutch mechanism 30 may be fixed relative to the rod 261, and the rotational end piece 28 may be configured to transition linearly along at least a portion of the rod 261 and rotated about the rod 261. For example, in some embodiments, the rotational end piece 28 may be configured to transition between a first position, where its teeth 282 are engaged with the teeth 301 of the clutch mechanism 30 (e.g., FIGS. 18 and 19) and a second position, where its teeth 282 are disengaged from the teeth 301 of the clutch mechanism 30 (e.g., FIG. 17).

FIGS. 18 and 19 illustrate the rotational end piece 28 in the first position. In some embodiments, the rotational end piece 28 may be placed in the first position when the rod 261 is moved linearly downward toward the mop head 22 and the projections 281 of the rotational end piece 28 engage the spiral track 268 in the hollow tube 165. When the rotational end piece 28 is in the first position, the rotational end piece 28 may be substantially prevented from rotating about the rod 261. As such, when the rotational end piece 28 is in the first position and the rod 261 is moved downward towards the mop head 22, movement of the projections 281 of the rotational end piece 28 along the spiral track 268 results in rotational movement of the hollow tube 265 in the first direction.

FIG. 17 illustrates the rotational end piece 28 in the second position. The rotational end piece 28 may be placed in the second position when the rod 261 is moved linearly upward, away from the mop head 22 and the projections 281 of the rotational end piece 28 engage the spiral track 268 of the hollow tube 265. When the rotational end piece 28 is placed in the second position, the rotational end piece 28 may be spaced apart from the clutch mechanism 30 such that the rotational end piece 38 may be configured to rotate about the rod 261. As such, when the rotational end piece 28 is in the second position and the rod 261 is moved linearly upwards, away from the mop head 22, movement of the projections 281 along the spiral track 268 results in rotational movement of the rotational end piece 28 without causing rotation of the hollow tube 265.

In some embodiments, such as the embodiment of FIGS. 16-19, the clutch mechanism 30 may be sized, shaped, and/or configured such that it may be fixed to the plug 262 and extend along and about the rod 261 to a position within the hollow tube 265 (see FIGS. 16 and 18). Alternatively, in some embodiments, such as the embodiments of FIGS. 14 and 15, the clutch mechanism (not shown) may be sized, shaped, and/or configured such that it may be fixed to a first portion of the rod 261 within the hollow tube 265 and may extend to a second portion of the rod 261 within the hollow tube 265.

FIG. 16 further illustrates that the rotational mechanism may include a biasing member 263, such as a spring. The biasing member 263 may be configured to bias the rotational mechanism 26 in an extended position, such that a mop assembly user may quickly, easily, and/or efficiently transition the first telescoping piece 201 linearly up and down relative to the second telescoping piece 203.

As illustrated in FIG. 17, the biasing member 263 may be configured to extend around and along the rod 261. In some embodiments of the rotational mechanism 26', 26", such as those illustrated in FIGS. 14 and 15, the biasing member 263', 263" may be sized, shaped, and/or configured to extend directly around and along the rod 261. Alternatively, in some embodiments, such as the embodiment of FIGS. 16 and 17, the biasing member 263 may be sized, shaped and/or configured to extend around and along the clutch mechanism 30 that may be positioned around and along the rod 261.

FIGS. 16 and 17 further illustrate that the biasing member 263 may be any size, shape, and/or configuration such that it may be configured to engage and extend from a bottom end of the plug 261 to a position between the bottom end of the plug 262 and the top end of the cuff 266. For example, in some embodiments, such as the embodiments of FIGS. 14 and 16-17, the biasing member 263, 263' may be configured to extend to a position that may be adjacent to a top edge of the cuff 266. Alternatively, in some embodiments, such as the embodiment of FIG. 15, the biasing member 263" may be configured to extend to a position along a middle portion of the rod 261.

The biasing member 263 may be configured to contract and expand in response to an application of a force on the first telescoping piece 201 in a linear direction. As such, in some embodiments, the rotating mechanism 26 may include one or more components that may be configured to control contraction and/or expansion of the biasing member 263. For example, in some embodiments, the rotating mechanism may include a stop 267 that may be configured to abut a top end of the cuff 266, such that when the stop 266 abuts the top end of the cuff 266 and force is applied to the first telescoping piece 201 in a linearly downward direction towards the mop head 22, the biasing member 263 may be configured to contract.

In some embodiments of the rotational mechanism 26', 26", such as the embodiments of FIGS. 14 and 15, the biasing member 263', 263" may be configured to achieve a substantially fully contracted position. Alternatively, in some embodiments, such as the embodiment of FIGS. 16-18, the rotating mechanism 26 may include a component 269 that may be configured to extend around both the rod 261 and the biasing member 263 such that contraction of the biasing member 263 may be configured to stop when the bottom end of the plug 262 abuts a top end of the component 269. This limits the range of linear translations of the first telescoping piece 201 with respect to the second telescoping piece 203.

In use, a user of a mop assembly and mop bucket assembly may first fill the mop bucket 18 with a liquid, such as water, up to a desired height. Then, as shown in FIGS. 11 and 12, while the locking mechanism 209 is in a locked position such that the first and second telescoping pieces 201, 203 are not configured to move relative to one another, the user may engage the mop head 22 with the central portion 144 of the basket 14 such that the mop head retaining means 142 may be configured to engage and exert a clamping force on the mop head 22 and such that the mop head 22 is not rotatable relative to the basket 14. The user may then apply linear forces to the mop handle 20, which may be configured to cause the supporting member 16 that supports the basket 14 to transition along the tracks 182 in the mop bucket 18 in order to place the mop head 22 and basket 14 in a desired position relative to the liquid in the mop bucket 18.

For example, in some embodiments, the user may engage the mop head 22 with the basket 14 when the projections 166 of the supporting member 16 are positioned within respective notch portions 188 of the stop 186 in the track 182. If the user desires to wet the mop head in the liquid in the mop bucket 18, the user may first apply an upwards linear force on the mop handle 20, which may be configured to disengage the projections 166 from their respective notches 188 and transition them into the track 182 via one of the access paths 189*a*, 189*b*. Then the user may apply a downward linear force on the mop handle 20, which may be configured to transition the supporting member 16 away from the open end 183 of the mop bucket 18 so that the basket 14 and mop head 22 may be immersed in the liquid in the mop bucket 18.

After wetting the mop head 22, the user may want to wring out excess liquid from the material 242 of the mop 24 engaged with the mop head 22. This may be accomplished by application of an upward linear force on the mop handle 20 in order to transition the supporting member 16 upwards towards the open end 183 of the mop bucket 18. Transitioning of the supporting member 16 upwards along the tracks 182 may stop when the projections 166 enter their respective notch portions 166 via one of the access paths 189*a*, 189*b*.

After the user positions the basket 14 in the mop bucket 18 such that the projections 166 are within their respective notch portions 166, the user may unlock the locking mechanism 209 of the mop handle 20 such that the first and second telescoping pieces 201, 203 may be configured to move relative to one another, and wring out excess liquid from the material 242 of the mop 24 engaged with the mop head 22 via the application downward and upward linear forces on the first telescoping piece 201. When the user applies upward and downward linear forces on the first telescoping piece 201, the material 242 of the mop 24 engaged with the mop head 22 may be wrung out in response to the simultaneous rotation of the second telescoping piece 203, the mop head 22 and the basket 14 in a single direction about the central protrusion 162 of the support member 16. After a desired amount of liquid has been wrung out from the material 242, the user may remove the mop head 22 from the mop bucket assembly 10 by applying force on the mop handle 20 when the mop handle 20 is at a non-vertical angle relative to the mop head 22, which may cause the mop head 22 to disengage from both the central portion 144 of the basket 14 and the mop head retaining means 142 within the basket 14.

After desired use of the mop, the user may repeat the previously discussed steps in order to re-wet the material 242 and/or wring out the material 242. The user may wet, wring out, and/or re-wet the material 242 without bending down and/or removing the mop from the mop bucket 18. Accordingly, use of the mop and mop bucket 18 as discussed herein may result in wetting, wringing out, and/or re-wetting of the mop head 22 in manner that may be comfortable and efficient to the mop assembly and mop bucket user.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty, which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter.

What is claimed:

1. A mopping assembly, comprising:

a mop bucket having a basket and an interior track formed on an inner surface thereof; and a mop having a mop head configured to engage the basket;

wherein the basket engages the track on an interior surface of the bucket, and so that the basket transitions within an interior portion of the bucket in a vertical direction along the longitudinal axis of the bucket;

wherein the track includes a stop having a notch portion, and wherein the basket is configured to access the notch portion via one or more access paths.

2. The mopping assembly of claim 1, further comprising a supporting member disposed in the mop bucket, wherein the supporting member releasably engages and supports the basket, and wherein the supporting member includes projections that engage the interior track of the mop bucket.

3. The mopping assembly of claim 2, wherein the stop is positioned on the track between a top end of the bucket and a bottom end of the bucket.

4. The mopping assembly of claim 2, wherein the projection is configured to access the notch portion via two access paths.

5. The mopping assembly of claim 4, wherein the two access paths are separated by a rail that defines an edge of each access path.

6. The mopping assembly of claim 2, wherein the supporting member includes a central protrusion and the basket is configured to engage the central protrusion via a corresponding recess and rotate about the central protrusion relative to the bucket.

7. The mopping assembly of claim 6, further comprising an arm extending from the central protrusion of the supporting member, wherein the projection extends from the arm.

8. The mopping assembly of claim 7, further comprising a plurality of arms, wherein each arm includes a projection, and a plurality of tracks, wherein each track corresponds to one of the plurality of arms and wherein each track includes a stop having a notch portion.

9. The mopping assembly of claim 2, wherein the mop head comprises a base, having an opening configured to engage a central portion of the basket so that the mop head is not rotationally movable with respect to the basket.

10. The mopping assembly of claim 9, further comprising a plurality of ribs formed in the basket and configured to exert a radially compressive force on the mop head.

* * * * *